US008834055B2

(12) United States Patent
Uchiyama et al.

(10) Patent No.: US 8,834,055 B2
(45) Date of Patent: Sep. 16, 2014

(54) CLEANING DEVICE HAVING PLURAL AND CUSTOMIZABLE CLEANING SURFACES

(71) Applicant: The Procter & Gamble Company, Cincinnati, OH (US)

(72) Inventors: Hirotaka Uchiyama, Loveland, OH (US); Mimi Gizaw Daniel, Cincinnati, OH (US); Glenn Allen Bradbury, Mason, OH (US); David William Schuller, Lebanon, OH (US); Agnes Elaine Wells, Colerain Township, OH (US); Michelle Lynn Borman, Cincinnati, OH (US); Aaron Fredrick Dubas, Cincinnati, OH (US); Adam Robert-George Shafer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/013,053

(22) Filed: Aug. 29, 2013

(65) Prior Publication Data

US 2013/0340186 A1 Dec. 26, 2013

Related U.S. Application Data

(63) Continuation of application No. 12/911,932, filed on Oct. 26, 2010, now Pat. No. 8,684,619.

(51) Int. Cl.

| | |
|---|---|
| ***A46B 11/02*** | (2006.01) |
| ***A46B 5/02*** | (2006.01) |
| ***A47L 13/12*** | (2006.01) |
| ***A47L 13/16*** | (2006.01) |
| ***A47L 13/26*** | (2006.01) |
| ***A46B 11/00*** | (2006.01) |
| ***A46B 5/00*** | (2006.01) |
| ***A46B 9/00*** | (2006.01) |

(52) U.S. Cl.

CPC ..... *A47L 13/26* (2013.01); *A46B 2200/30* (2013.01); *A47L 13/12* (2013.01); *A46B 11/0075* (2013.01); *A46B 5/0058* (2013.01); *A46B 11/0017* (2013.01); *A46B 5/02* (2013.01); *A46B 9/005* (2013.01); *A46B 11/0041* (2013.01)

USPC ..... 401/270; 401/137; 401/139; 401/268

(58) Field of Classification Search

USPC ..... 401/23–27, 39, 134, 135, 137–140, 401/145, 167, 180, 266, 268, 270; 15/114, 15/143.1, 159.1

See application file for complete search history.

(56) References Cited

U.S. PATENT DOCUMENTS

| | | | |
|---|---|---|---|
| 846,346 | A | 3/1907 | Rich |
| 1,821,505 | A | 9/1931 | Field |

(Continued)

FOREIGN PATENT DOCUMENTS

| | | | |
|---|---|---|---|
| EP | 1 708 605 | B1 | 7/2008 |
| EP | 1868745 | B1 | 2/2012 |

(Continued)

OTHER PUBLICATIONS

U.S. Appl. No. 12/911,932, filed Oct. 26, 2010, Uchiyama, et al.

(Continued)

*Primary Examiner* — David Walczak
*Assistant Examiner* — Joshua Wiljanen
(74) *Attorney, Agent, or Firm* — Larry L. Huston; Steven W. Miller

(57) ABSTRACT

A device for cleaning debris from a target surface. The device has a sole plate with permanent bristles and a removable/replaceable pad. The device also has a replaceable, on-board supply of cleanser. The pad/cleanser may be replaced when depleted and replaced with a new pad/cleanser or may simply be replaced with a new pad/cleanser when that pad/cleanser is more suitable for a particular cleaning task.

15 Claims, 5 Drawing Sheets

(56) References Cited

U.S. PATENT DOCUMENTS

| | | | | |
|---|---|---|---|---|
| 3,113,703 | A | 12/1963 | Rundle | |
| 4,124,316 | A | 11/1978 | O'Rourke | |
| 2,859,463 | A | 11/1985 | Hirsch | |
| 4,776,716 | A | 10/1988 | Huang | |
| 5,299,876 | A | 4/1994 | Singarella | |
| 5,522,110 | A | 6/1996 | Borofsky | |
| 5,584,091 | A | 12/1996 | Borofsky | |
| 5,827,001 | A | 10/1998 | Taghavi-Khanghah | |
| 6,224,283 | B1 | 5/2001 | Hay | |
| 6,547,643 | B1 | 4/2003 | Miller, III et al. | |
| 6,595,712 | B2 | 7/2003 | Sickler | |
| 6,866,165 | B2 | 3/2005 | Heathcock et al. | |
| D513,102 | S | 12/2005 | Davis-Wilson et al. | |
| 7,007,338 | B2 * | 3/2006 | Garabedian et al. | 15/231 |
| 7,021,494 | B2 | 4/2006 | Mazooji et al. | |
| D522,201 | S | 5/2006 | Davis-Wilson et al. | |
| 7,159,265 | B2 | 1/2007 | Soller et al. | |
| 7,210,185 | B2 * | 5/2007 | Paas | 15/49.1 |
| D578,720 | S | 10/2008 | Norcorn et al. | |
| D583,156 | S | 12/2008 | Constantine | |
| 7,610,647 | B2 | 11/2009 | Morgan et al. | |
| 7,624,469 | B2 | 12/2009 | Specht et al. | |
| 7,631,386 | B1 * | 12/2009 | Santiago et al. | 15/22.1 |
| 7,682,097 | B2 | 3/2010 | Knopow et al. | |
| 7,707,674 | B2 * | 5/2010 | Schonewille et al. | 15/28 |
| 7,779,501 | B2 | 8/2010 | Lacotta et al. | |
| 8,025,453 | B2 * | 9/2011 | Chan | 401/202 |
| 8,627,986 | B2 * | 1/2014 | Bradbury et al. | 222/402.11 |
| 2003/0074756 | A1 | 4/2003 | Policicchio et al. | |
| 2004/0231700 | A1 | 11/2004 | Bell et al. | |
| 2005/0086754 | A1 | 4/2005 | Dalias | |
| 2006/0168748 | A1 | 8/2006 | Dotterman et al. | |
| 2006/0168750 | A1 | 8/2006 | Dotterman et al. | |
| 2006/0277706 | A1 * | 12/2006 | Clark et al. | 15/231 |
| 2007/0071535 | A1 * | 3/2007 | Young et al. | 401/138 |
| 2008/0098546 | A1 | 5/2008 | Warmka et al. | |
| 2009/0106920 | A1 | 4/2009 | Wahi | |
| 2010/0092232 | A1 | 4/2010 | Gallardo | |
| 2010/0154822 | A1 | 6/2010 | Reed et al. | |
| 2011/0107545 | A1 | 5/2011 | Cagnina et al. | |
| 2011/0146018 | A1 | 6/2011 | Vasilakes et al. | |
| 2012/0096662 | A1 | 4/2012 | Uchiyama et al. | |
| 2012/0110765 | A1 | 5/2012 | Lin | |
| 2013/0047358 | A1 * | 2/2013 | Shafer et al. | 15/114 |

FOREIGN PATENT DOCUMENTS

| | | | |
|---|---|---|---|
| GB | 1303249 | A | 1/1973 |
| WO | WO 03/016165 | | 2/2003 |
| WO | WO 2004/096001 | A1 | 11/2004 |
| WO | WO 2005/084516 | A1 | 9/2005 |
| WO | WO 2005/112688 | | 12/2005 |
| WO | WO 2005112688 | A1 | 12/2005 |
| WO | WO 2006/083629 | A1 | 10/2006 |
| WO | WO 2009/021103 | A2 | 2/2009 |

OTHER PUBLICATIONS

Commercially available Products downloaded from the internet Aug. 2010, 21 pages.

* cited by examiner

CLEANING DEVICE HAVING PLURAL AND CUSTOMIZABLE CLEANING SURFACES

FIELD OF THE INVENTION

The present invention relates to cleaning devices and more particularly to cleaning devices usable to remove plural kinds of debris deposited on a hard surface.

BACKGROUND OF THE INVENTION

Cleaning devices for hard surfaces are well known in the art. Such devices may be handheld or deployed on the end of an elongate handle, to extend the user's reach.

The head of the device may include bristles, sponge, microfiber nonwoven, terry cloth, nonwoven, foam and other cleaning materials, as are known in the art. But the material well suited for cleaning one type of debris from a particular surface may be poorly suited for cleaning different debris from that same surface. Or the material may be poorly suited for cleaning that same debris from a different surface.

For example, one may desire to clean a shower area. The shower area may have different kinds of tile, each with different surface characteristics. The shower area may further have glass, marble, synthetic solid surface material, grout, caulk, plastic and/or ceramic surfaces. Each of these surfaces may require different treatments to optimize cleaning. For example, a cleaning material which works well on glass or ceramic might scratch a plastic surface. A cleaning material suitable for flat surfaces may not work well for faucets.

Complicating, the situation are the various types of debris found on a common surface. A single surface may have soluble and insoluble debris, oil-based debris, soap scum, food stains, algae, etc. Or plural surfaces in a single area, such as, by non-limiting way of example a shower, may have plural types of debris—further complicating the cleaning task.

Further complicating the cleaning task is the interaction between the cleaning material and any cleanser used therewith. Particular cleansers work more efficaciously with particular cleaning materials.

A single cleaning material is not optimized to clean plural types of debris from plural types of surfaces in a single cleaning task. One solution to this problem is for the user to interrupt the cleaning process mid-task and exchange the cleaning device. But this solution complicates the problem by requiring the purchase and storage of plural cleaning devices as well as extending the time necessary to complete the cleaning task.

An attempt to improve upon this solution is to provide a cleaning device having plural cleaning surfaces. For example, a cleaning device having dual texture bristles are known in the art. A device having a separately usable scrubber and sponge, is taught by U.S. Pat. No. 7,624,469. Some cleaning devices have renewable surfaces, as illustrated by commonly assigned U.S. D513,102 S; D522,201 S and D578,720 S. Another device accommodates a continuous liquid flow path, as taught by U.S. Pat. No. 6,595,712.

But these attempts in the art do not overcome the problems encountered trying to clean plural surfaces having plural types of debris with a single device. Accordingly, a new solution is needed.

SUMMARY OF THE INVENTION

The invention comprises a device for cleaning debris from a target surface. The device has a sole plate with a permanent cleaning surface and a removable/replaceable cleaning surface. The replaceable cleaning surface may comprise a foam pad. The device also has a replaceable, on-board supply of cleanser. The pad/cleanser may be replaced when depleted and replaced with a new pad/cleanser or may simply be replaced with a new pad/cleanser which may be more suitable for a particular cleaning task. The device may be sold with a plurality of containers of cleanser and/or a plurality of replaceable pads.

DETAILED DESCRIPTION OF THE INVENTION

Figure 1:
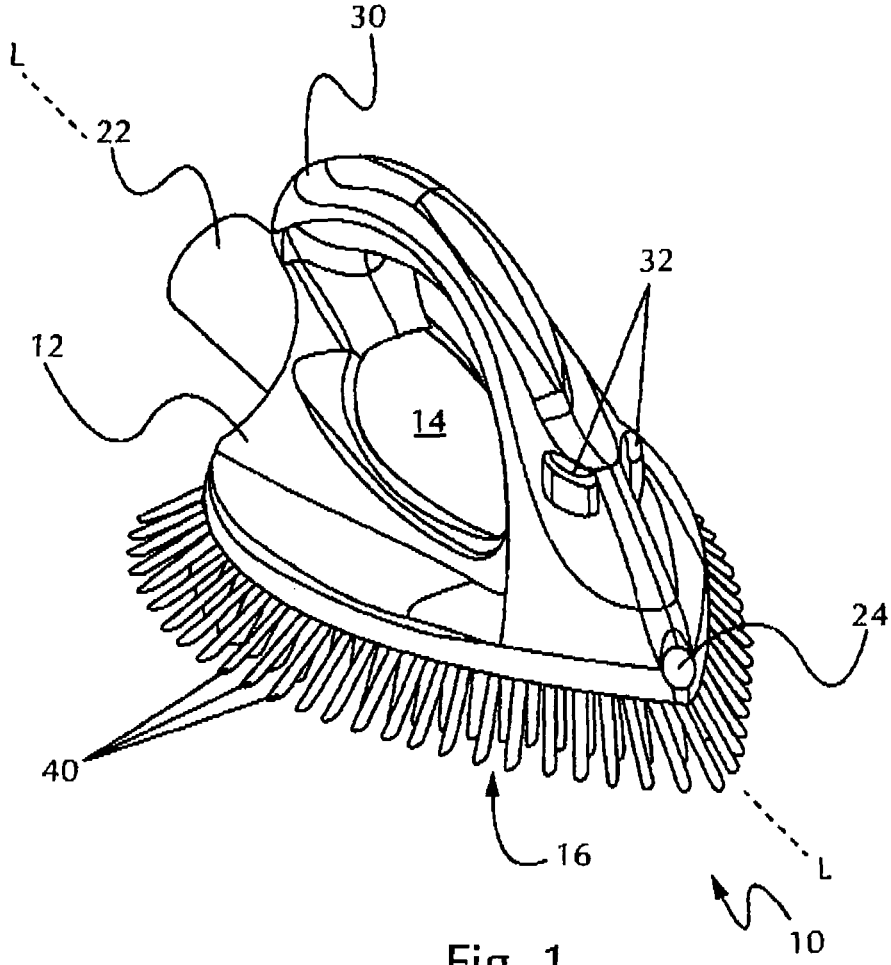
FIG. 1 is a perspective view of a cleaning device according to the present invention.

Referring to FIG. 1, the device 10 according to the present invention comprises a sole plate 12 for contacting the surface to be cleaned, an optional handle 30, and a renewable cleanser supply. The sole plate 12 has a top 14, or upwardly facing surface to which the handle 30 may be attached. The sole plate 12 may further have a nozzle 24 for dispensing cleanser therefrom and directly or indirectly onto the target surface to be cleaned.

Figure 2:
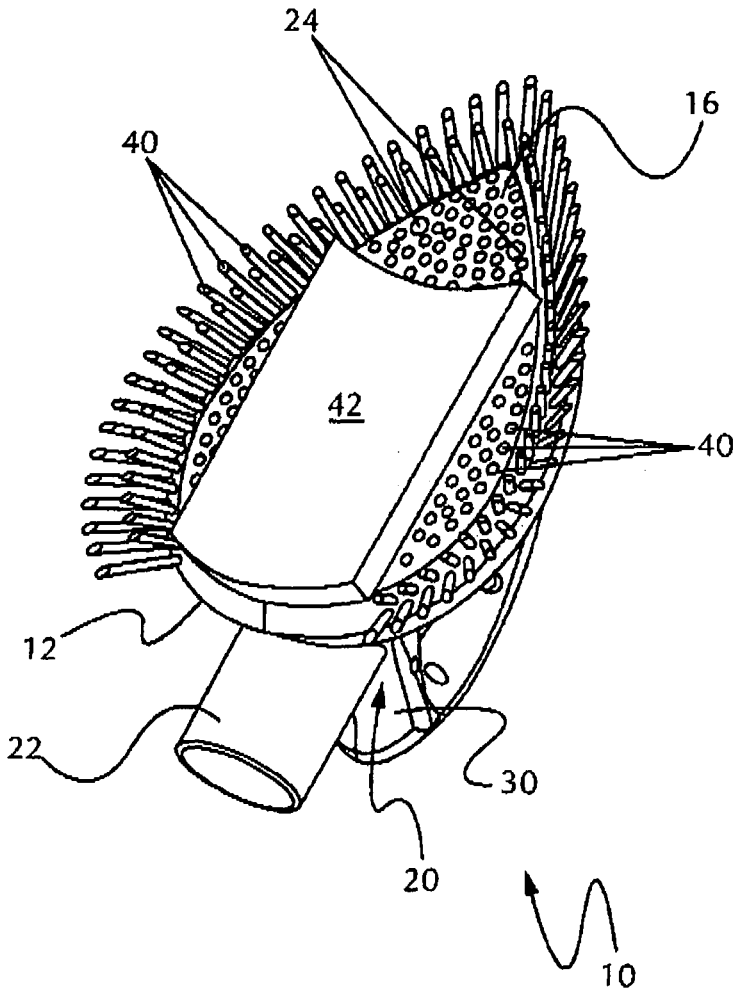
FIG. 2 is a perspective view of the device FIG. 1, showing the bottom of the device.

Referring to FIG. 2, the sole plate 12 further has a bottom 16 or downwardly facing surface. The bottom 16 of the sole plate 12 may be flat, concave slightly convex or a combination thereof. The sole plate 12 may further comprise a receptacle 20 for receiving a supply of the cleanser.

Referring back to FIG. 1 and examining the device 10 in more detail, the device 10 may have a longitudinal axis L-L and be symmetric thereabout. The device 10 may be symmetric or asymmetric about the longitudinal axis L-L.

The sole plate 12 may be generally flat, having a top 14 and a bottom 16 generally opposed thereto. The optional handle 30 may be a loop style handle 30 as shown, and may be joined to the sole plate 12 at a first end and, optionally, at a second end spaced apart therefrom. The handle 30 may be parallel the longitudinal axis L-L as shown, skewed relative thereto or perpendicular thereto. The handle 30 may be generally parallel to the bottom 16 of the sole plate 12, as shown. If the handle 30 is not present, the user may grip the sides of the cleaning device 10 for manipulation during the cleaning process.

The front of the device 10 may have a point, for reaching into corners. The back of the device 10 may comprise a receptacle 20 for receiving a supply of the cleanser. Alternatively, the receptacle 20 for the cleanser may be disposed on the top 14 of the device 10. For example, the handle 30 may be hollow and comprise the receptacle 20 to contain the cleanser.

The cleanser may be liquid, foam, gel or a combination thereof with or without particulates suspended therein. If desired, liquid cleanser may be provided in an aerosol container 22, as is known in the art. The aerosol container 22 may be metal, plastic such as PET, etc. and may be removably inserted into a complementary receptacle 20. The aerosol container 22 may have a longitudinal axis, defining the major dimension of that container 22. Suitable liquid cleansers may comprise surfactants, organic acids, chelating agents, pH adjusting compounds, perfumes, disinfectants, anti-microbials, preservatives. etc.

The cleanser may be sprayed from the device 10 through any suitable nozzle 24 or plurality of nozzles 24. In one embodiment, the cleanser may be forwardly sprayed in a fan pattern from a nozzle 24 coincident the longitudinal axis. Alternatively, the cleanser may be sprayed forward and laterally from a pair of nozzles 24 offset from the longitudinal axis. Alternatively, the nozzle 24 may be disposed in the handle 30, to provide more elevation of the spray pattern from the target surface. Or one or more nozzles 24 may be disposed on the bottom 16 of the sole plate 12. The nozzle 24 may also be a simple opening, to provide a dribble of the cleanser or may provide a spray, as is known in the art.

Any such nozzle 24 arrangement, and particularly a forward or laterally spraying nozzle 24, provides the benefit that the sprayed cleanser has residence time on the debris before being contacted by the bottom 16 of the sole plate 12. The residence time provides the benefit of solubilizing water soluble debris, for more efficacious cleaning of that debris. One suitable spray pattern is found in commonly assigned application Ser. No. 12/770862, Case 11317, filed Apr. 30, 2010.

The spray maybe activated using a manual actuator, as is known in the art. One manual actuator is a push button 32, as is known in the art. The pushbutton 32 is manually depressed by the user and may open a valve in the aerosol container 22, as is known in the art. The pushbutton 32 may be juxtaposed with the handle 30 so that the user can grip and manipulate the device 10 at the same time the pushbutton 32 is depressed. This arrangement allows for cleaning a first area while simultaneously spraying a second area to be cleaned.

Referring to FIG. 2, the container 22 of cleanser may be removably inserted into the receptacle 20 by sliding the container 22 forward. The container 22 may be cylindrically shaped as is common in the art, and disposed in the receptacle 20 generally parallel to the longitudinal axis. This arrangement provides improved lateral balance to the device 10, by concentrating the weight of the cleanser supply on the longitudinal axis. The improved lateral balance likewise improves user ergonomics.

When the cleanser contained in the aerosol container 22 is depleted, it may be removed, discarded, and replaced with an aerosol container 22 having a fresh supply of cleanser. The container 22 of cleanser may likewise be replaced when a cleanser customized for a different cleaning task, target surface, debris, or pad 42 is desired.

If desired, the device 10 may have plural cleansers mixed at the point of use. For example a first cleanser may be contained in an aerosol container 22 and a second cleanser may be contained in hollow handle 30. Additionally or alternatively, hollow handle 20 may have a receptacle 20 divided into plural compartments. The plural compartments may contain identical, complementary or other mutually different cleansers.

Figure 4:
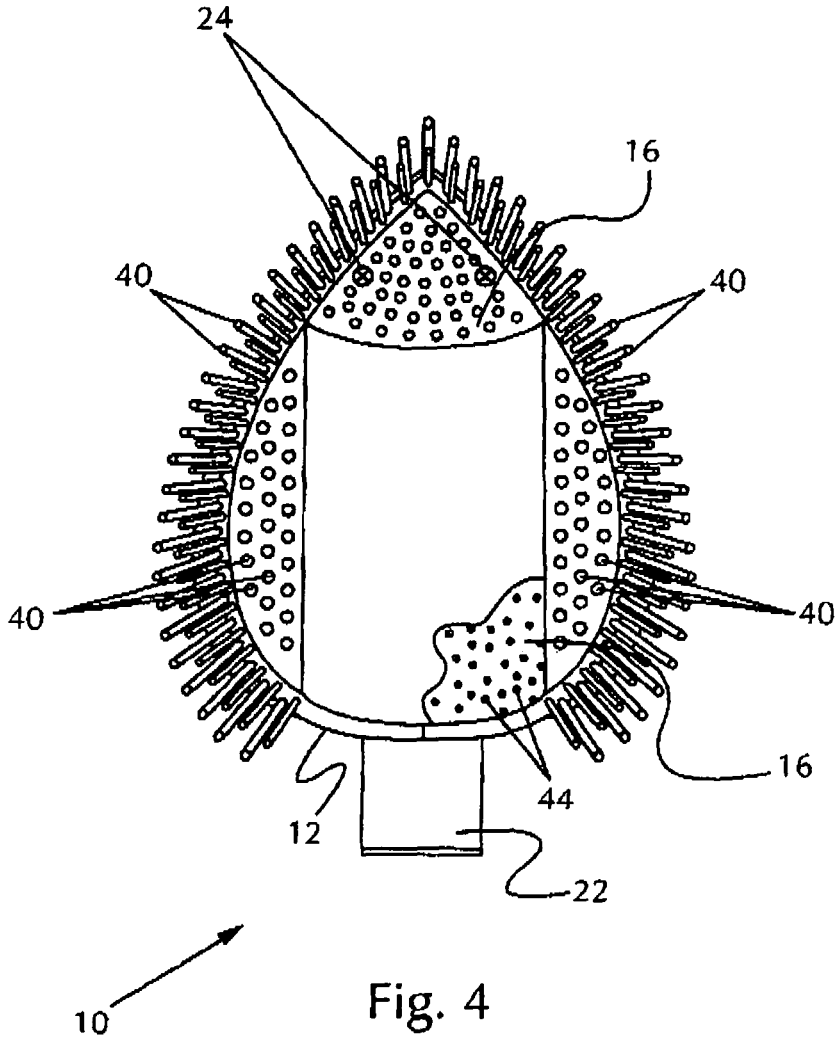
FIG. 4 is a bottom plan view of the device of FIG. 1, having the replaceable pad shown partially in cutaway.

Referring to FIGS. 2 and 4, the bottom 16 of the sole plate 12 may comprise the cleaning surface. The cleaning surface may comprise plural cleaning materials such as permanent bristles 40, and/or nonwoven scrubby material made of nylon, polypropylene, PET, PE, etc. and combinations thereof. The bristles 40 may be permanent, so that replacement thereof during the life of the device 10 is unnecessary. The bristles 40 may be generally peripherally disposed about the perimeter of the sole plate 12.

If desired, plural types of bristles 40 may be utilized. A first plurality of bristles 40 may be perimetrically disposed about the periphery of the sole plate 12. The first plurality may be the outermost bristles 40 of the sole plate 12. The outermost bristles 40 may be relatively stiff, for scrubbing corners and edges. Further, the outermost bristles 40 may be disposed at an outwardly oriented angle relative to the bottom 16 of the sole plate 12. The outwardly oriented angle of the bristles 40 provides for reaching into corners and other hard-to-access areas.

The second plurality of bristles 40 may be disposed intermediate the first plurality of bristles 40 and the replaceable pad 42. The second plurality of bristles 40 may be less rigid, or in a variant embodiment more rigid, or in a degenerate case equally rigid as the first plurality of bristles 40. Likewise, the second plurality of bristles 40 may be longer, shorter, or of equal length as the first plurality of bristles 40. In yet another embodiment, the first plurality of bristles 40 and second plurality of bristles 40 may be intermixed as to properties such as rigidity, length, hydrophobicity, hydrophilicity, absorbency, etc. If desired, the bristles 40 may be coated with any of the cleanser chemistries described hereinbelow or otherwise known to one of ordinary skill.

The replaceable pad 42 may be removably attached to the bottom 16 of the sole plate 12 using hook and loop type fasteners 44, adhesive disposed on the replaceable pad 42 and combinations thereof. The hook fasteners 44 may be molded into the bottom 16 of the sole plate 12 and the complementary loop material may be provided by the replaceable pad 42 and inherent in the material thereof.

One suitable replaceable pad 42 comprises melamine foam, as is sold by the instant assignee under the name Mr. Clean Eraser. The replaceable pad 42 may be generally planar and have an outwardly facing surface for contacting the target surface and removing debris therefrom. The pad 42 may further absorb cleanser sprayed or otherwise dispensed through the nozzle 24.

If desired, the replaceable pad 42 may be impregnated with cleanser. The cleanser may be complementary to or the same as the cleanser sprayed from the supply. The replaceable pad 42 may comprise melamine foam, as set forth in U.S. Pat. No. 7,629,043 or in commonly assigned 2009/172828 A1, now abandoned, or alternatively may comprise polyurethane foam, natural or synthetic sponge, and combinations thereof If desired, the replaceable pad 42 may optionally be covered with any suitable cover, such as a nonwoven, the nonwoven optionally being textured, including a microfiber nonwoven, a textured polyolefinic film and combinations thereof. The microfiber nonwoven may have a basis weight of 15 to 100 gsm, 60 to 90 gsm or 80 gsm. A microfiber nonwoven may comprise PET/Nylon, PE/PP, etc., as is known in the art.

The cover may be disposed only on the outwardly facing surface of the removable pad 42 or, alternatively, may cover the outwardly facing surface and the surface opposed thereto so that when the first surface becomes soiled, the replaceable pad 42 may simply be inverted/reattached for continued cleaning.

When the replaceable pad 42 becomes too soiled for efficacious cleaning, it may simply be removed from the sole plate 12 and discarded. A new efficacious pad 42 may then be attached to a space on the bottom 16 of the sole plate 12 and deployed for cleaning. A pad 42 comprising polyurethane foam and a 60 gsm nonwoven microfiber may provide cleaning efficacy due to the polyurethane foam absorbing and reapplying cleanser while the microfiber nonwoven traps debris. By absorbing and reapplying the cleanser during the cleaning process, less cleanser needs to be carried on board the device 10, so that the device 10 may be lighter in use and therefore more ergonomic.

The device 10 may have a reservoir 20 of cleanser or one or more containers 22 of cleanser. The cleanser or container 22 thereof may have a volume of less than 250, 200, 150, or 100 ml. The device 10 may have a weight of, less than 750, 700, 650, 600, 550, 500, 450, 400, 350, 300, or 250 grams with the container 22 of cleanser and the pad 42 installed. Such a relatively light weight is particularly suitable for a cleaning device 10 having a handle 30 intended for single hand operation. If the device 10 has an elongate handle 30A, the device 10 may be slightly heavier, due to the two-handed operation possible with the elongate handle 30A.

To keep the center of gravity near the handle, the device 10 may have a container 22 installed in the receptacle 20. The receptacle 20, and any container 22 installed therein may be intermediate the bottom 16 of the sole plate 12 and the handle 30. The receptacle 20, and any container 22 installed therein may be disposed above the bottom 16 of the sole plate 12 and within the handle 30. This arrangement provides a center of gravity disposed juxtaposed with center of the device 10.

If desired, the space which receives the removable pad 42 may be of constant width as shown, or maybe a variable width and/or depth. If desired, two or more, different pads 42 may be inserted into the space. This arrangement allows a first pad 42 to be inserted which is customized for a particular type of cleaning and a second, or more additional pads 42, to be likewise inserted and customized for a different type of cleaning. By simultaneously using plural replaceable pads 42, the cleaning surface of the device 10 may be customized to the particular task at hand.

Figure 3:
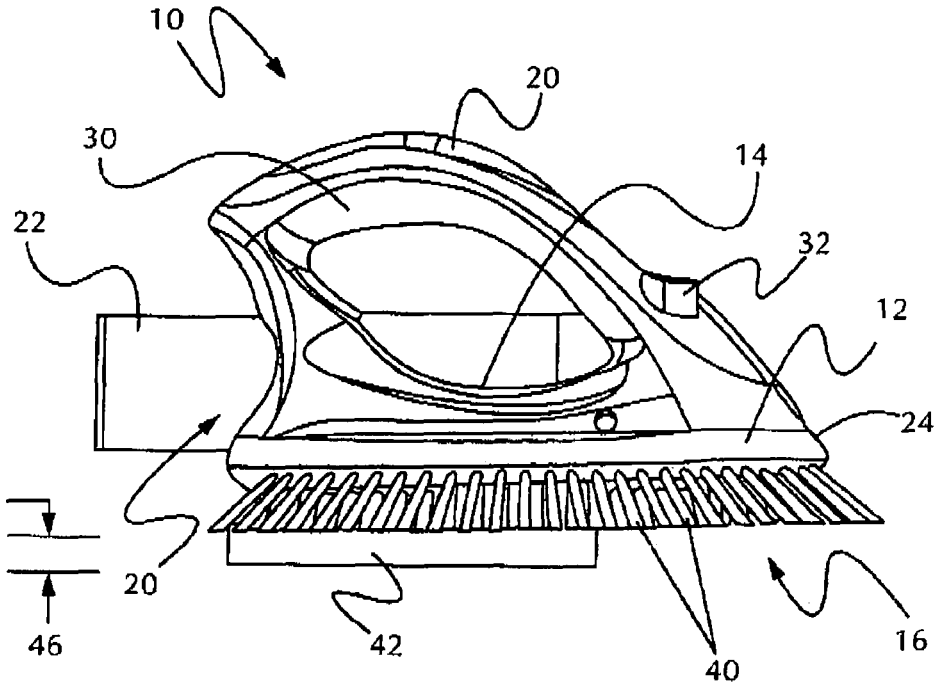
FIG. 3 is a side elevational view of the device of FIG. 1 having a hollow handle shown partially in cutaway.

Referring back to FIG. 3, the pad 42 may extend further outwardly from the device 10 than the bristles 40 extend, i.e. the pad may extend downwardly from the sole plate 12 further than the bristles 40. This extension creates a step differential 46, which allows the pad 42 to contact the target surface for light cleaning and allowing the pad 42 to reach into grout or other recessed areas. If desired, the pad 42 may be compressed by the user, so that the bristles 40 may contact the target surface and be used for scrubbing and heavier cleaning.

Figure 5:
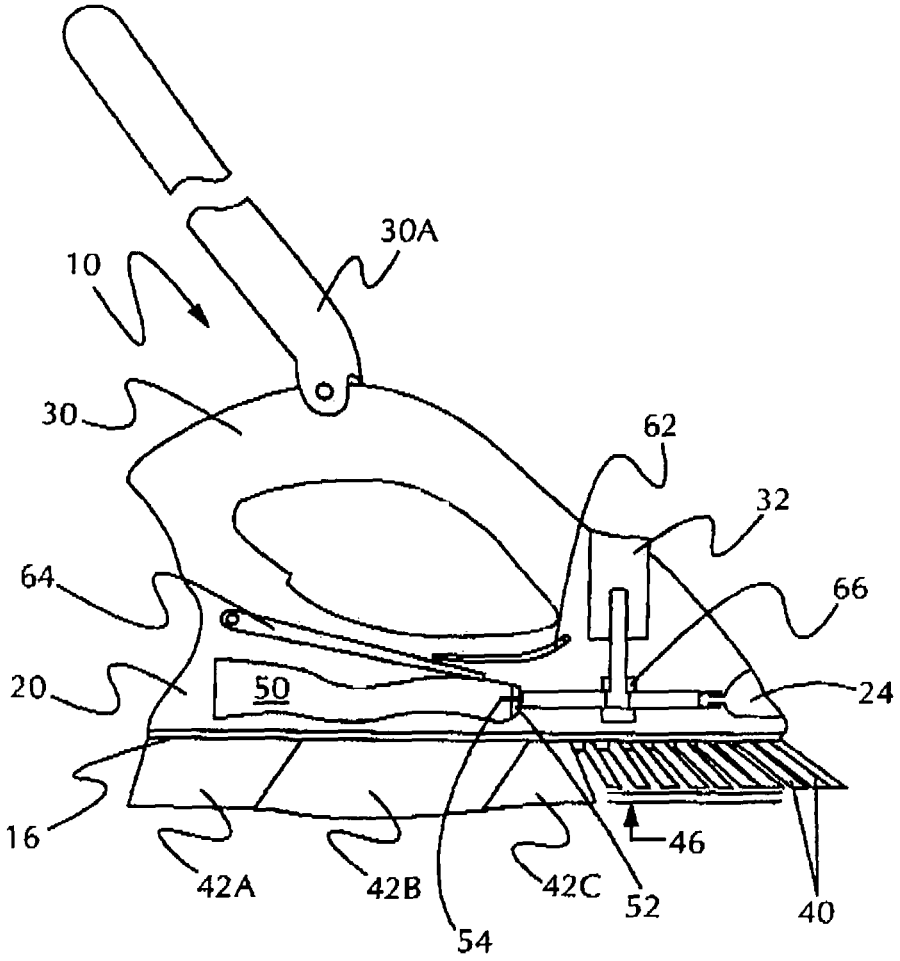
FIG. 5 is a fragmentary vertical sectional view of an alternative embodiment having an elongate handle, trigger sprayer and a cleanser supply comprising a bag and pierceable membrane.

If a step differential is desired between the bristles 40 or other permanently attached cleaning material and the pad 42, the step differential may be or variable or constant as shown. If a constant step differential is selected, the differential may range from 2 to 20, or from 5 to 10 mm Referring to FIG. 5, in a variant embodiment, If desired, a variable step differential 46 may be provided by selecting a removable pad 42 having a concave/convex outwardly facing surface a permanent cleaning surface, such as bristles 40 having a convex/concave outwardly facing surface or a combination thereof. The particular nonlimiting exemplary device 10 of FIG. 5 has three nested concave pads 42A, 42B and 42C, collectively forming an outwardly facing concave surface. This exemplary device 10 further has bristles 40 collectively forming a concave surface. The bristles 40 in the forward trisection of the permanent cleaning material, are exemplarily thicker than the bristles 40 in the central and rear trisections of the permanent cleaning material.

The device 10 may have an elongate handle 30A. The elongate handle 30A may be connected to the sole plate 12 through a universal joint or single-axis pivot, as is known in the art. The elongate handle 30A provides greater reach than the loop handle 30 and may be curved or may be straight, as shown. The elongate handle 30A may be removable from the device 10, so that the device 10 is used with handle 30 for tight spaces or compact cleaning tasks.

The cleanser supply may comprise a flexible bag 50 having a pierceable membrane 52. The flexible bag 50 may have a longitudinal axis, defining the major dimension of the flexible bag 50.

The piercable membrane 52 may be made of rubber, such as silicone, TPE, etc. The pierceable membrane 52 is punctured by a hollow needle 54, permanently joined to the sole plate 12, handle 30, etc. In this embodiment, cleanser flows from the interior of the flexible bag 50, through the hollow needle 54, and is sprayed out the nozzle 24. A suitable system for use in this embodiment is shown in commonly assigned U.S. Pat. Nos. 6,386,392; 6,321,941; and 6,685,056. The bag 50 may be disposed in a spring loaded chamber, so that compression of the bag 50 by the spring 62 provides motive force for dispensing liquid therefrom.

For example, a spring 62, e.g. a leaf spring 62, may bias an articulating plate 64 against the flexible bag 50 to express cleanser therefrom. Alternatively or additionally, the spring 62 may directly contact and impinge the collapsible bag 50 to dispense cleanser therefrom. Dispensing of the cleanser may occur in response to manipulation of button 32 and concomitant opening of valve 66 intermediate the pierceable membrane 52 and nozzle 24.

Motive force for spraying the fluid contained in the flexible bag 50 may alternatively be provided by a manual actuator, such as a trigger sprayer, as is known in the art. Alternatively, motive force may be provided by manually squeezing the flexible bag 50, expressing fluid therefrom, through the needle 54. Alternatively, the cleanser may be sprayed from the bag 50 using a manually operated positive displacement pump, such as a peristolic pump, piston pump a gear pump, diaphragm pump, etc. The pump may be driven by a motor, such as a battery powered DC motor.

This bag 50 arrangement provides the benefit that when the cleanser is depleted, the bag 50 may be removed and either refilled or may be replaced with a new bag 50 having a fresh supply of cleanser. Refilling the bag 50 from a larger reservoir allows the bag 50 to be reused. Alternatively, as noted above, the device 10 may have a hollow portion in the handle 30 and/or sole plate 12 providing a reservoir to contain the cleanser.

The device 10 according to the present invention, cleanser and replaceable pad 42 may be sold in a kit form. The kit may have a device 10 having a permanent cleaning material intended for prolonged and several uses. One or more supplies of cleanser 22 may be included in the kit form. The supplies of the cleanser may be mutually identical or may be different, allowing for customizing the cleanser choice for a particular task. Likewise, the kit may include one or more replaceable pads 42. The replaceable pads 42 may be mutually identical or may be different, allowing for customizing the pad 42 choice for a particular task.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for cleaning debris from a target surface and having a longitudinal centerline, said device comprising:

a sole plate having a top and a bottom generally opposed thereto, said bottom of said sole plate comprising a cleaning material permanently attached thereto and extending outwardly therefrom and further comprising a space for receiving a removable pad thereon, said device further comnrising a generally planer pad removably installed in said space on the bottom of said sole plate wherein said planar pad has an outwardly facing surface and comprises one of a nonwoven cover or a microfiber cover thereon;

a receptacle for receiving a cleanser or a container of cleanser therein, said receptacle being joined to and substantially overlying said sole plate; and a manual actuator for dispensing cleanser from the container, through a nozzle and onto the target surface forwardly of said sole plate.

2. A device according to claim 1 having a handle wherein said handle is hollow and structured to receive cleanser therein.

3. A device according to claim 1 wherein said nozzle is disposed on said longitudinal centerline.

4. A device according to claim 3 wherein said nozzle forwardly sprays said cleanser in a fan pattern.

5. A device according to claim 1, wherein said receptacle is shaped to receive a complementary cylindrically shaped container of cleanser.

6. A device according to claim 5 wherein said receptacle is shaped to receive said cylindrically shaped container coincident said longitudinal axis and parallel to said bottom of said sole plate.

7. A device for cleaning debris from a target surface, said device comprising:

a sole plate having a top and a bottom generally opposed thereto, said bottom of said sole plate comprising bristles permanently attached thereto and extending outwardly therefrom, and further comprising a space for a pad to be removably attached to the bottom of said sole plate, a handle integrally joined to said sole plate;

a receptacle having an aerosol container of cleanser within said handle, said receptacle being at least partially disposed within said handle and substantially overlying said sole plate, whereby a user can press said handle to apply compressive force to a pad disposed on said sole plate; and a manual actuator for dispensing cleanser from said container, through a nozzle and onto the target surface.

8. A device according to claim 7 wherein a plurality of said bristles are peripherally disposed about said bottom of said sole plate.

9. A device according to claim 8 wherein said plurality of bristles extends outwardly from said bottom of said sole plate in acute non-perpendicular angular relationship relative to said bottom of said sole plate, to a vertex, said vertex being suitable for cleaning a corner.

10. A device according to claim 9 wherein said aerosol container has a plastic body and volume less than or equal to 250 ml.

11. A device according to claim 10 further comprising a pad joined to said bottom of said sole plate, said device weighing less than 750 grams with said pad and said cleanser installed.

12. A device according to claim 9 further comprising a pad disposed on said bottom of said sole plate and having a step differential between said bristles and said pad.

13. A device for cleaning debris from a target surface having a longitudinal axis, said device comprising:

a sole plate having atop and a bottom generally opposed thereto, said bottom of said sole plate comprising a space for removably receiving a cleaning pad thereon;

a handle rigidly joined to said top of said sole plate and having a top remote from said sole plate, whereby a user can press said handle to apply compressive force to a pad disposed on said sole plate;

a receptacle for removably receiving a longitudinally oriented aerosol container of cleanser therein, said receptacle being disposed intermediate the top of said sole plate and said top of said handle, said container substantially overlapping said sole plate when received in said receptacle, wherein said longitudinally oriented aerosol container is received on said longitudinal axis parallel to and offset from said bottom of said sole plate and at least a portion of said aerosol container overlies said bottom of said sole plate when disposed in said receptacle; and a forwardly disposed pushbutton actuator, said actuator being juxtaposed with said receptacle for opening a valve in said aerosol container to dispense cleanser from said container in response to actuation by a user, said cleanser being then forwardly dispensed through a nozzle and onto the target surface forwardly of said sole plate.

14. A device according to claim 13 wherein said receptacle removably receives said longitudinally oriented aerosol container by forwardly sliding said aerosol container into said receptacle in the longitudinal direction, whereby said aerosol container is intermediate said bottom of said sole plate and the top of said handle.

15. A device according to claim 13 wherein said pushbutton actuator is disposed on said handle.

* * * * *